United States Patent [19]

Lapsker

[11] Patent Number: 4,807,909

[45] Date of Patent: Feb. 28, 1989

[54] PRESCRIPTION ASSEMBLY

[75] Inventor: Joshua Lapsker, Thornhill, Canada

[73] Assignee: Promo-Ad Canada Ltd., Concord, Canada

[21] Appl. No.: 92,684

[22] Filed: Sep. 3, 1987

[51] Int. Cl.[4] ..... B42D 15/00; B42D 12/00; B42D 1/04; B42D 3/06

[52] U.S. Cl. ..... 283/67; 283/900; 281/15 R; 281/17

[58] Field of Search ..... 281/3 R, 15 R, 15 B, 281/16, 21 R, 22 B, 45, 17, 33; 282/22 R, 24 A, 24 C; 283/4, 31, 32, 33, 36, 40, 52, 63, 67, 107, 109, 900

[56] References Cited

U.S. PATENT DOCUMENTS

| | | | |
|---|---|---|---|
| 372,458 | 11/1887 | Cristadoro | 283/42 |
| 730,083 | 6/1903 | Beach | 283/900 |
| 1,121,197 | 12/1914 | McMillan | 281/17 |
| 1,656,217 | 1/1928 | Miller et al. | 281/17 |
| 2,283,584 | 5/1942 | Sloan | 281/33 |
| 2,301,449 | 11/1942 | Penny | 281/17 |
| 3,208,772 | 8/1965 | Dahlstrand | 281/15 R |
| 3,348,325 | 10/1967 | Snelgrove | 283/36 |

FOREIGN PATENT DOCUMENTS

| | | | |
|---|---|---|---|
| 1248458 | 11/1960 | France | 283/900 |

*Primary Examiner*—Paul A. Bell
*Assistant Examiner*—Paul M. Heyrana, Sr.
*Attorney, Agent, or Firm*—Bachman & LaPointe

[57] ABSTRACT

An assembly for incorporation in a binder assembly facilitates distribution of free starter sample dosages of prescription pharmaceuticals to patients; in particular, the starter dosage is dispensed by a pharmacist based on a preprinted prescription form completed by a physician; the form includes a control stub which is completed and removed by the pharmacist who then presents it to a control body for reimbursement; the control body collates particulars of sample dosages prescribed.

17 Claims, 5 Drawing Sheets

PRESCRIPTION ASSEMBLY

BACKGROUND OF THE INVENTION (i) Field of the Invention

This invention relates to an assembly, more especially a prescription pad assembly as well as to a system of monitoring and controlling the dispensing of samples of prescription pharmaceuticals.

(ii) Description of Prior Art

Certain pharmaceuticals are only available for purchase with a written prescription from a physician. In such case, the physician writes out a prescription, sometimes known as an Rx, for an appropriate pharmaceutical for the patient, the patient takes the prescription to a pharmacist who dispenses the pharmaceutical in accordance with the prescription and obtains payment from the patient.

In the marketing and promotion of pharmaceuticals it is a common practice for pharmaceutical corporations to provide physicians with sample packages of their pharmaceutical products. The physicians then provide their patients with such samples free of charge, whereby a determination can be made by the physician as to whether or not the pharmaceutical is suitable for the needs of the individual patient, without the patient incurring the expense of purchasing the product. At the same time the physician develops goodwill with the patient since the patient s not faced with purchasing a product which may prove unsatisfactory for his particular needs.

The practice is advantageous for the pharmaceutical company since the physician is more likely to prescribe a pharmaceutical which he has been able to determine is satisfactory for the particular needs of his patient, by an initial free sample.

The benefits are such that the practice of providing free samples is wide spread. There are, however, a number of disadvantages in the existing practice.

For the pharmaceutical company there are the disadvantages associated with the expense of producing and distributing small sample packages, the expense of which is incurred whether or not the physician actually uses them. The pharmaceutical company has no control over the manner in which the physician uses the samples, for example, a physician might provide a patient with a sufficient amount of free samples that the patient's needs are fully met without purchasing product, or perhaps with expired product which is no longer effective.

The number and geographical distribution of physicians makes it almost impossible to provide all physicians with a supply of samples and ensure that supplies are replenished as needed.

There is no ready means for the pharmaceutical company to determine if its program of free samples is effective in producing sales.

For the physician there are the disadvantages associated with the need to safely store a wide variety of free samples while keeping them readily accessible for patients. In addition the physician has some responsibility to ensure that he does not maintain expired product. These factors present additional time consuming administration problems for busy physicians.

The present invention seeks to overcome disadvantages associated with the conventional practice as hereinbefore described.

It is an object of this invention to provide a system for monitoring and controlling the dispensing of prescription pharmaceuticals whereby a physician prescribes a free sample which is dispensed by a pharmacist.

Particular objects of the invention include such a system which avoids the need for manufacture and distribution of small sample packages, and expense of samples which are not administered, avoids the need for the physician to maintain or store any supplies of samples, which makes efficient and effective use of supplies of the pharmaceutical held by the pharmacist in the provision of free samples, which avoids abuse of the free sample program by over-sampling, avoids the problem of expired product in the possession of the physician, and facilitates assessment of the effectiveness of the free sample program in generating sales.

It is another object of the invention to provide an assembly especially suited for the system of the invention.

It is still another object of the invention to provide an assembly facilitating ready and controlled dispensing of a sample dosage of a prescription pharmaceutical.

SUMMARY OF THE INVENTION

In accordance with one aspect there is provided an assembly comprising as components a first plurality of sets of sheet means, the sheet means of each set bear distinct data different from the sheet means of the other sets; and, a second plurality of identification means, with a holder uniting the components as a unitary assembly.

In the unitary assembly each identification means is disposed so as to have a predetermined association with one of the sets. The sheet means of each set have a pre-printed first sheet member and a pre-printed second sheet member; the first and second members bear pre-printed inter-related data.

In yet another aspect of the invention there is provided a system of monitoring and controlling the dispensing of sample or starter dosages of prescription pharmaceuticals. In accordance with this system a plurality of sets of sheet means is provided in which the sheet means of each set bear distinct data different from the sheet means of the other sets. The sheet means each comprise a pre-printed first sheet member and a pre-printed second sheet member; the first and second sheet members of a set bear inter-related data for a defined sample dosage of a prescription pharmaceutical and suitably both the first and second sheet members have zones for entry of information.

A sample dosage defined by a first sheet member of a sheet means is dispensed to a patient by a pharmacist, without charge, on presentation to the pharmacist of the first sheet member usually after it has been completed by a physician in a zone of the first sheet member to identify the patient.

The pharmacist is reimbursed on presentation of the second sheet member of the sheet means to a control body, usually after completion in the appropriate zone to enter the identity of the pharmacist.

Information derived from a plurality of second sheet members presented by pharmacists is correlated to provide information with respect to distribution of the sample dosages.

DESCRIPTION OF PREFERRED EMBODIMENT

Suitably the sets comprise pads of sheets, each sheet being comprised of a first sheet member attached to a second sheet member, with the second sheet member of a sheet being readily separable from the first sheet member of the sheet, for example, by means of a perforation along a line of attachment of the first and second sheet members. Most suitably the first and second sheet members have zones for entry of information by the physician and pharmacist.

In an especially practical embodiment the assembly further includes an indexing means related to the identification means.

In a particular embodiment the pre-printed data represents prescriptions for sample dosages of specified brand pharmaceuticals; and the unitary assembly is adjustable from a closed configuration in which the indexing means and identification means are all displayed while the sets or pads are substantially concealed, to a third plurality of open configurations in each of which one of the sets or pads is displayed.

Generally the first, second and third pluralities all have the same numerical value n where n is a whole number integer greater than 1 and typically 3 to 10.

The assembly suitably includes a plurality of panel members, in particular n+2, including cover panels and divider panels disposed or sandwiched between the cover panels in a closed configuration. Each divider panel supports one of the sets or pads such that the sets or pads are each inter-related with an identification means associated with an adjacent panel disposed outwardly of the set or pad.

In another aspect of the invention there is provided a binder assembly incorporating the assembly.

Although the sets conveniently comprise pads of the sheets in which the sheets are fixed together at one end and are collectively supported on a support card, other configurations of sets are within the scope of the invention. Thus the sets may comprise packages or collections of the sheet means, for example, a collection of sheet means of a set might be housed in one or more envelopes.

Similarly although in a preferred embodiment the first and second sheet members of a sheet means are attached so as to form a single sheet or form, with the second sheet member readily separable from the first sheet member, it is also within the scope of the invention to employ sheet means in which the first and second sheet members are discrete separate sheets. In such a case the first and second sheet members of a set are still associated with each other in the unitary assembly. All that is required is that the first and second sheet members of a set be sufficiently associated in the unitary assembly that the physician can readily remove from the unitary assembly a sheet means of a set in which the first and second sheet members have the interrelated data with respect to a specific pharmaceutical prescription.

The first and second sheet members of a set means may themselves be supported in first and second pads, each first pad of first sheet members being associated in the unitary assembly with a second pad of second sheet members of the same set means. By way of example such first and second pads can be independently mounted on an associated divider panel, either on the same or opposed sides of such panel.

BRIEF DESCRIPTION WITH REFERENCE TO THE DRAWINGS

DESCRIPTION OF PREFERRED EMBODIMENT WITH REFERENCE TO THE DRAWINGS

Figure 1:
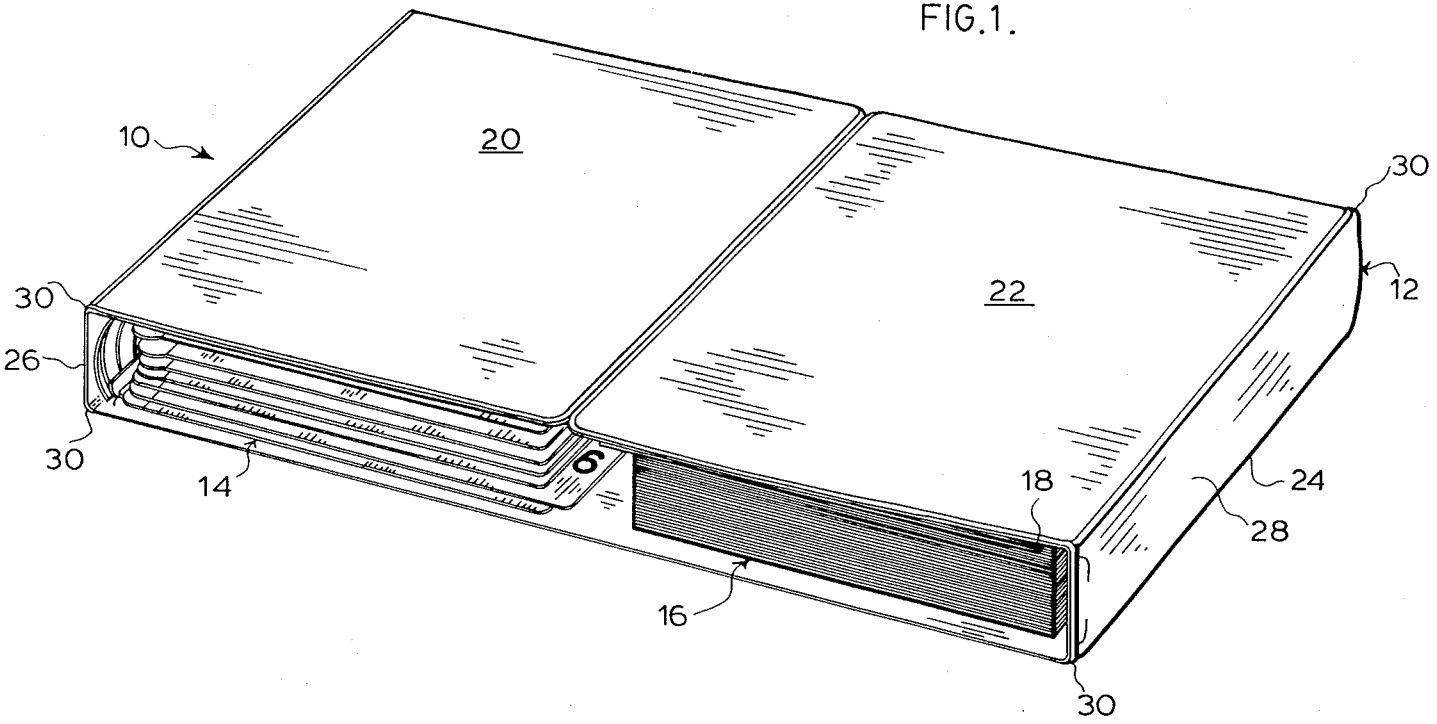
FIG. 1 is a perspective view of a binder assembly in accordance with the invention in a closed configuration.
Figure 2:
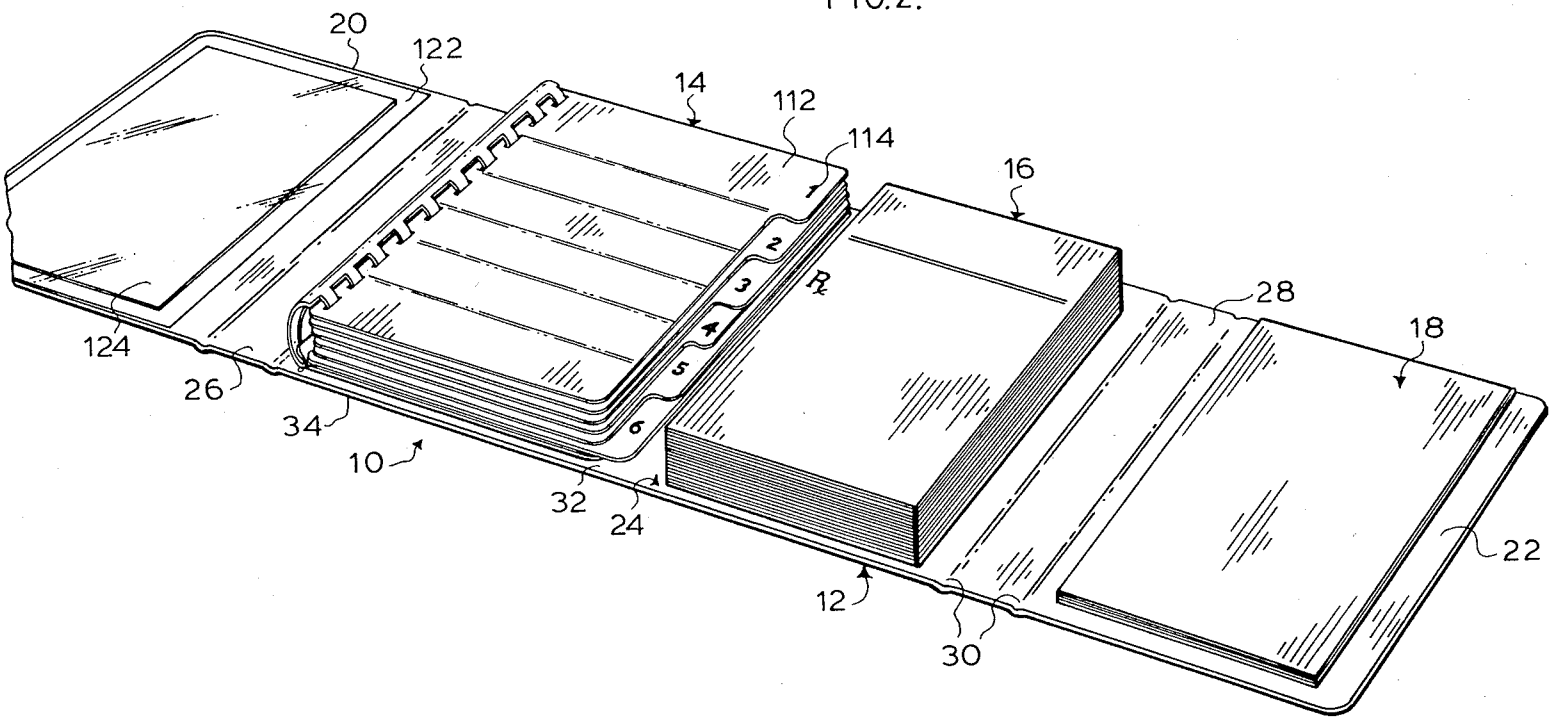
FIG. 2 is a perspective view of the binder assembly of FIG. 1 in an open configuration.
Figure 3:
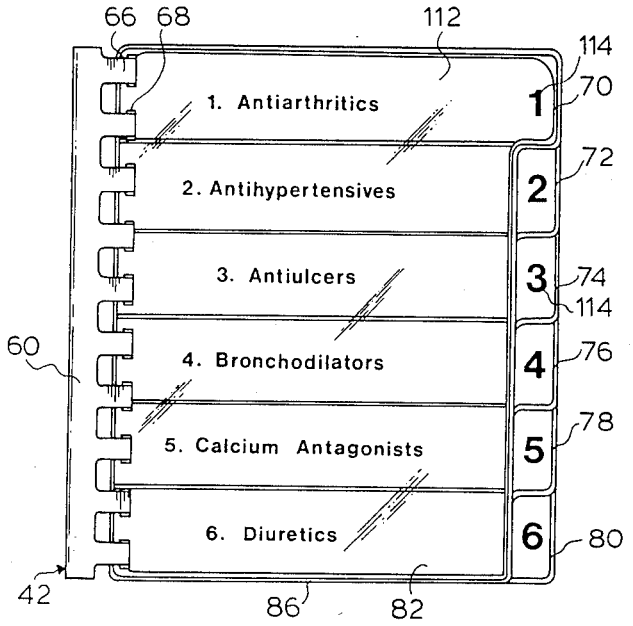
FIG. 3 is a front view of a pad assembly of the invention removed from the binder assembly of FIG. 1 in a closed configuration.
Figure 5:
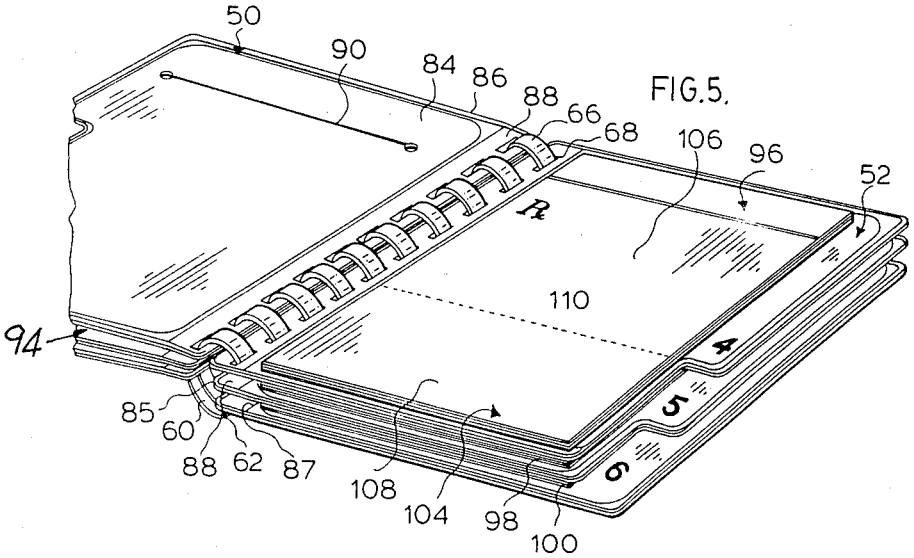
FIG. 5 is a perspective view of the assembly of FIG. 3 in one of the plurality of open configurations.

With further reference to FIGS. 1 and 2, a binder assembly 10 has a jacket 12 housing a pad assembly 14, a personalized prescription pad 16 and an information booklet 18.

Jacket 12 has front panel-like covers 20 and 22, rear panel-like cover 24, spines 26 and 28 and folds 30. Spine 26 is disposed between front cover 20 and rear cover 24, and spine 28 is disposed between front cover 22 and rear cover 24. A fold 30 is formed between each of front cover 20 and spine 26, spine 26 and rear cover 24, rear cover 24 and spine 28, and spine 28 and front cover 22.

Jacket 12 includes an inner layer 32 and an outer layer 34 secured together at least at their outer edges. Suitably layers 32 and 34 may be of a synthetic fabric-like material, for example, plastic, heat welded or adhered together at their adjacent outer edges.

A pocket 36 is formed between inner layer 32 and 34 on an inside face of the rear cover 24 which underlies front cover 20 in a closed configuration of jacket 12; a pocket 38 is formed between inner layer 32 and outer layer 34 on an inside face of rear cover 24 which underlies front cover 22 in such closed configuration; and a pocket 40 is formed between inner layer 32 and outer layer 34 on the inside face of front cover 22.

With particular reference to FIGS. 3, 4, 5 and 6, pad assembly 14 includes a hinge 42, an outer cover panel 44, an inner cover panel 46 and divider panels 48, 50, 52, 54, 56 and 58.

Hinge 42 includes a spline 60 having an outer free edge 62 and an inner edge 64. A plurality of spaced apart fingers 66 extends from inner edge 64 in curved fashion, the outer ends of fingers 66 being flexingly engaged by spline 60.

The outer cover panel 44, the inner cover panel 46 and divider panels 48, 50, 52, 54, 56 and 58 each have a plurality of spaced apart slots 68 through which fingers 66 pass, whereby the panels 44 to 58 are flippably, hingedly mounted on hinge 42.

Outer cover panel 44 includes a tab 70 and divider panels 48, 50, 52, 54 and 56, each have respective tabs 72, 74, 76, 78 and 80.

Each of panels 44 to 58 has a transparent front wall 82 and a transparent rear wall 84 sealed together at a peripheral edge 86. Divider panels 48, 50, 52, 54, 56 and 58 are additionally sealed along a line 87 spaced inwardly of an inner edge 85 of peripheral edge 86, a mounting strip 88 being defined between line 87 and edge 85 in which are formed the slots 68.

A pocket 90 is formed between the front wall 82 and rear wall 84, and adjacent the mounting strip 88 of each of the divider panels 48, 50, 52, 54, 56 and 58.

Pads 92, 94, 96, 98, 100 and 102 are supported in the pocket 90 of respective divider panels 48, 50, 52, 54, 56 and 58.

Each of pads 92, 94, 96, 98, 100 and 102 includes a plurality of forms 104 in stacked relationship and affixed together adjacent one end, the plurality of forms 104 being supported on a support card 105. In each case support card 105 is received in a pocket 90 to mount a pad, for example, pad 92, in the appropriate panel, i.e., panel 48 in the case of pad 92.

Each of the forms 104 has a prescription sheet or script 106 bearing a pre-printed prescription for a sample dosage of an identified pharmaceutical, and a control stub 108 similarly identifying the prescription. Each form 104 includes a perforation 110 between sheet 106 and control stub 108.

The pre-printed prescription of forms 104 of a pad, for example, pad 92, are all identical and different from the pre-printed prescription of forms 104 of the other pads, for example, pad 94.

An index 112 is disposed between walls 82 and 84 of outer cover panel 44 and an indicium 114 is displayed by each of tabs 70, 72, 74, 76, 78 and 80.

Pad 16 comprises a plurality of regular prescription forms 116.

In a particular embodiment as shown, the indicia 114 are the integers 1, 2, 3, 4, 5 and 6; the indicium 1 is displayed in tab 70 of outer cover panel 44, the indicium 2 is displayed in tab 72, the indicium 3 in tab 74, the indicium 4 in tab 76, the indicium 5 in tab 78 and the indicium 6 in tab 80. As shown in FIG. 2, the indicium 114 are all displayed and visible in the open configuration when front cover 20 is raised.

Each indicium 114 appears with identification of the drug category in the index 112. Thus in the particular example the indicia 114 are identified with categories as follows:

| Indicium | Drug Category |
|---|---|
| 1. | Antiarthritics |
| 2. | Antihypertensives |
| 3. | Antiulcers |
| 4. | Bronchodilators |
| 5. | Calcium Antagonists |
| 6. | Diuretics |

Pad 92 is supported by divider panel 48 and is thus disposed immediately below outer cover panel of which tab 70 displays the indicium 1 which thus relates to pad 92. Index 112 indicates that the indicium 1 is for an antiarthritic. Thus each of the forms 104 of the pad 92 has a pre-printed prescription for a sample of a particular brand name antiarthritic.

Thus if the physician determines that a patient needs an antiarthritic, he refers to index and determines that antiarthritics are identified by the integer 1 of the indicia 114.

Flipping or lifting tab 70 displaying the integer 1 exposes or displays the pad 92. This represents one of the open configurations of the pad assembly 14.

By way of example, each form 104 of pad 92 includes a prescription sheet 106 personalized with the identity of the physician and pre-printed with a prescription for a sample or starter dosage of a specific brand name antiarthritic. The control stub 108 of such form 104 of pad 92 similarly identifies the sample dosage of the particular antiarthritic. The prescription sheet 106 includes a zone 118 for insertion by the physician of the identity of the patient who is to receive the identified sample dosage.

In use the physician enters in zone 118 particulars identifying the patient and removes the form 104 from the pad 92. The patient takes the form 104 to a pharmacist, the pharmacist provides the patient with the sample dosage prescribed on the form 104, without charge. Thereafter the pharmacist completes zone 120 on the rear side of control stub 108, particularly to insert particulars of his pharmacy and the date of dispensation of the sample. Thereafter the pharmacist removes control stub 108 from sheet 106 by tearing along perforation 110.

The rear side of prescription sheet 106 contains the information that the pharmacist needs and the procedure which he is to follow in order to obtain payment for the sample prescription dispensed. This procedure involves submitting the completed control stub 108 to an identified control body, which body attends to the reimbursement and assembles and collates information as to samples of each pharmaceutical prescribed; the information with respect to each pharmaceutical is submitted periodically to the pharmaceutical company which is the source of the pharmaceutical concerned.

In this way monitoring and control of sample dosages prescribed can be achieved. Problems associated with transport and delivery of samples to the physician and over-sampling by the physician to a particular patient can be avoided. Lack of accountability is avoided. The sample is dispensed by the pharmacist from the supply which he maintains for regular prescriptions.

In a particular embodiment the control stub 108 includes a depiction of the particular pharmaceutical showing, for example, the colour and shape of the tablet; this permits ready identification by the patient. In addition, the front face of the control stub 108 includes a box to be completed by the pharmacist to indicate if the form 104 was accompanied by a regular prescription, sometimes called Rx, for the pharmaceutical being sampled, such as may be written on a regular prescription form 116 from pad 16.

The binder assembly 10 and in particular pad assembly 14 ensures that the pharmaceutical company only incurs the costs and expense associated with free samples when a free sample has actually been dispensed to a patient by a pharmacist and avoids the additional expense associated with production of special small dosage sample packages and their delivery to physicians.

In addition a binder assembly 10 can readily be provided to physicians in areas which might not normally be visited by sales representatives of pharmaceutical companies who might be responsible for delivering packages of samples; similarly replacement pads 92 etc. can be readily dispatched to physicians.

The booklet 18 suitably contains prescribing information with respect to the specific brand pharmaceutical of each of the categories of index 112.

It will be understood that the pad assemblies 14 can be customized according to the needs of a particular physician with respect to the therapeutic categories, and also with respect to the particular drug of each category. Thus the specific antihypertensive of a pad 94 of one binder assembly 10 is not necessarily the same as the specific antihypertensive of a pad 94 of another binder assembly 10.

Furthermore, the invention is not restricted to the particular six therapeutic categories illustrated in index 112, and other drug categories can be included and there may be more or less than 6 categories, as desired. When the number of drug categories is n, where n is a whole number integer greater than 1, there will be n divider panels, similar to panels 48 to 58, n tabs similar to tabs 70 to 80, n indicia 114, n pads similar to pads 92 to 102 and n open configurations in which one of the n pads is displayed and accessible to the physician; including the outer and inner cover panels 44 and 46 there are n+2 panels.

Figure 4:
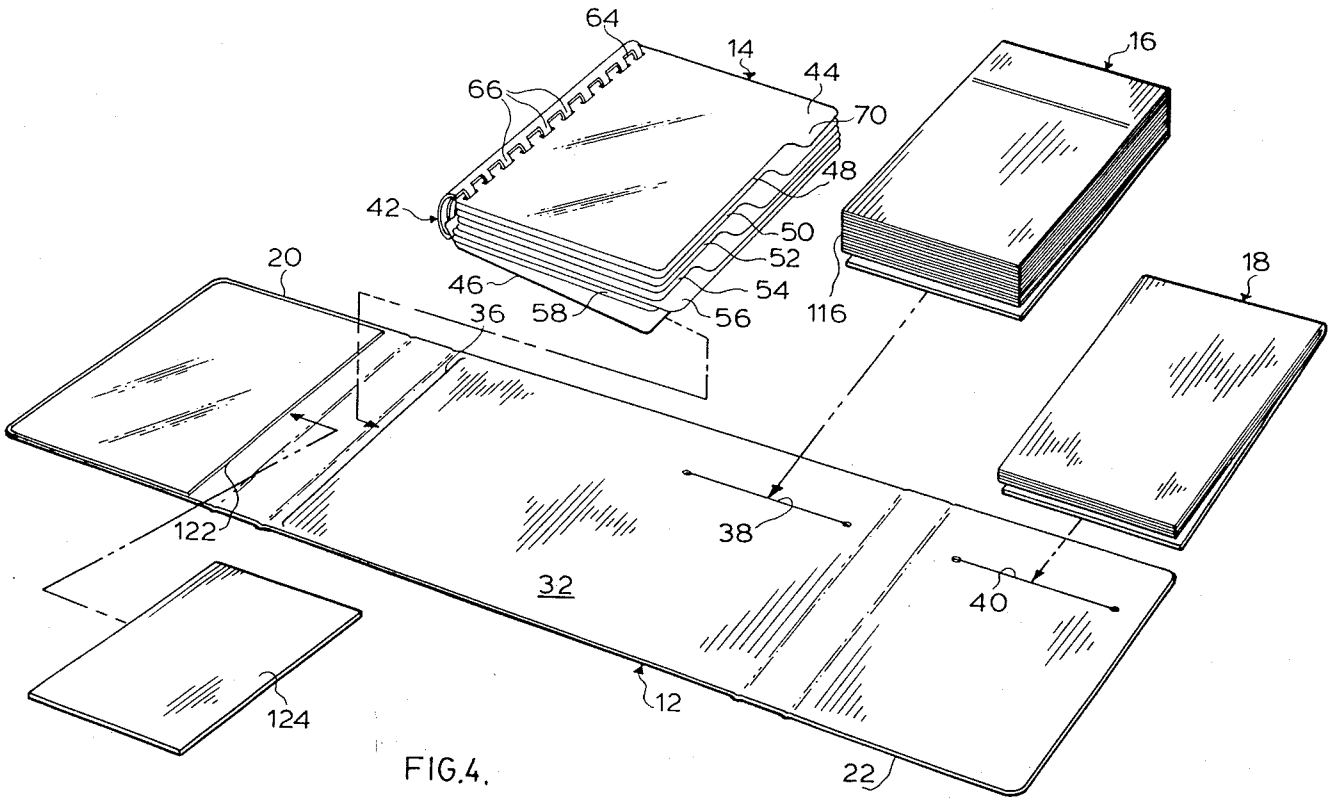
FIG. 4 is a perspective view of the assembly of FIG. 1 in an exploded configuration.
Figure 6:
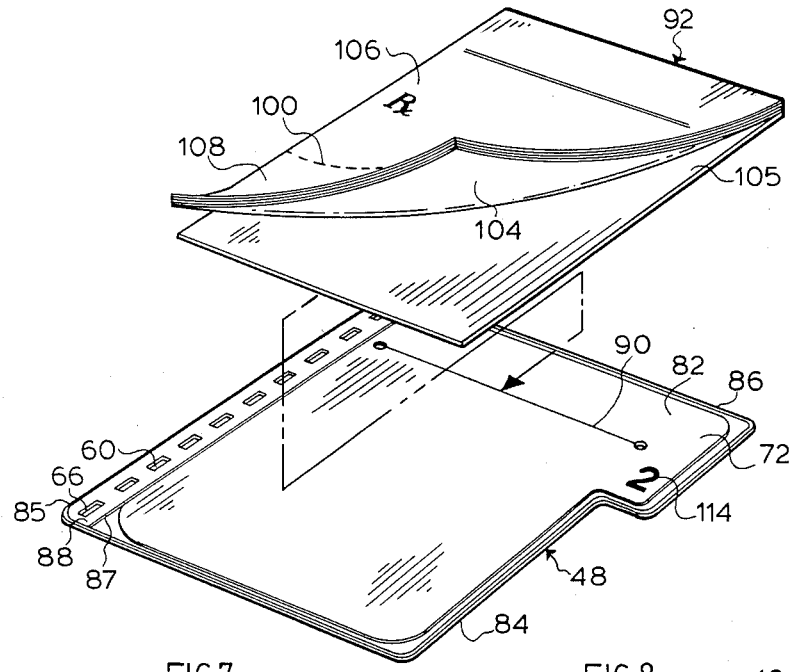
FIG. 6 is an exploded view of one pad of the assembly of FIG. 3 with its supporting panel.
Figure 7:
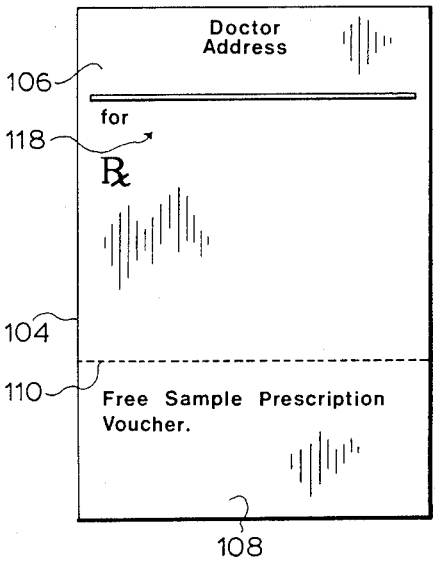
FIG. 7 is a front view of a form from a pad of the assembly of FIG. 3.
Figure 8:
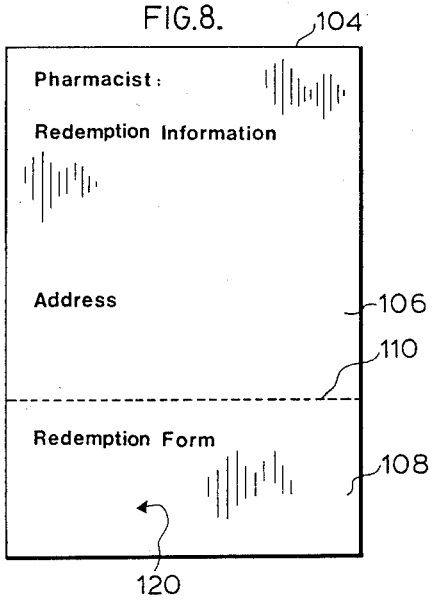
FIG. 8 is a rear view of the form of FIG. 7.

As particularly shown in FIGS. 2 and 4, front cover 20 may include a transparent pocket 122 which may be employed to house product data or advertising 124.

This invention may be embodied in other forms or carried out in other ways without departing from the spirit or essential characteristics thereof. The present embodiment with reference to the drawings is therefore to be considered as in all respects illustrative and not restrictive, the scope of the invention being indicated by the appended claims, and all changes which come within the meaning and range of equivalency are intended to be embraced therein.

I claim:

1. A prescription pad assembly for effecting free starter sample dosages of prescription pharmaceuticals comprising:

a plurality of sets of sheet means, the sheet means of each set of the said plurality bearing a sample dosage prescription for a distinct pharmaceutical product different from the sheet means of others sets of the said plurality, a plurality of identification means, each identification means relating to a said distinct pharmaceutical product of said sheet means, and holder means uniting said plurality of sets and said plurality of identification means as a unitary assembly with each identification means, for a distinct pharmaceutical product, of the said plurality in a predetermined association with a set of the said plurality for the same distinct pharmaceutical product, the sheet means of each set of the said plurality comprising a plurality of pre-printed first sheet members and a plurality of pre-printed second sheet members, the said first and second sheet members bearing pre-printed interrelated data for a free starter sample dosage prescription of a distinct pharmaceutical product.

2. An assembly according to claim 1, further including indexing means related to said identification means of the said plurality, said indexing means being part of said unitary assembly.

3. An assembly according to claim 1, wherein each first sheet member of a set is associated with a said second sheet member of the said set.

4. An assembly according to claim 1, wherein each first sheet member of a set is separably connected to a said second sheet member of the said set.

5. A prescription pad assembly for effecting free starter sample dosages of prescription pharmaceuticals comprising:

a plurality of pads of removable sheets, the sheets of each pad of the said plurality bearing a sample dosage prescription for a distinct pharmaceutical product different from the sheets of other pads of the said plurality, a plurality of identification means, each identification means relating to a said distinct pharmaceutical product of said sheets, indexing means related to said identification means of the said plurality, and holder means mounting said plurality of pads, said plurality of identification means and said indexing means, as a unitary assembly with each identification means, for a said distinct pharmaceutical product, of the said plurality in a predetermined association with a pad of said first plurality for the same distinct pharmaceutical product, the sheets of each pad having a pre-printed first portion and a pre-printed second portion readily separable from said first portion, said first and second portions bearing pre-printed interrelated data for a free starter sample dosage prescription of a distinct pharmaceutical product, and each of said first and second portions, and each of said first and second portions having zones for entry of information relating to said sample dosage prescription.

6. An assembly according to claim 5, wherein each sheet has a perforation between said first and second portions to facilitate the ready separation of said first and second portions.

7. An assembly according to claim 6, wherein said unitary assembly has a closed configuration in which said indexing means and said plurality of identification means are all displayed and said plurality of pads is concealed, and a plurality of open configurations, one of said pads of the said plurality being displayed in each of said open configurations, said pluralities of pads, identification means and open configurations having identical numerical values.

8. A unitary prescription pad assembly for effecting free starter sample dosages of prescription pharmaceuticals comprising:

a hinge member, a plurality of panel members comprising an outer cover panel, an inner cover panel and a plurality of divider panels, said panel members being hingedly mounted on said hinge member and disposed in an opposed facing relationship in a closed configuration, with said divider panels sandwiched between said outer and inner cover panels, said panel members being flippably movable about said hinge member from said closed configuration to a plurality of open configurations, a plurality of identification means, each identification means of the said plurality being associated with a panel member of said plurality of panel members selected from said outer cover panel and said divider panels, said plurality of identification means being disposed so as to be simultaneously displayed in said closed configuration, a plurality of pads of removable forms, the forms of each pad bearing a sample dosage prescription for a distinct pharmaceutical product different from the forms of other pads of the said plurality of pads, each pad of the said plurality being supported by a said divider panel such that the sample dosage prescription for a distinct pharmaceutical product on the said forms of a pad of the said plurality supported by the said divider panel interrelates with the identification means associated with an adjacent panel member disposed outwardly of the said divider panel, each identification means relating to a said distinct pharmaceutical product of the forms of a said pad, the said forms each having a pre-printed first portion and a pre-printed second portion separated by a line of weakness facilitating ready separation of said first and second portions, said first and second portions bearing pre-printed interrelated data for a free starter sample dosage prescription of a pharmaceutical product of a distinct therapeutic category, and each of said first and second portions having zones for entry of information relating to said sample dosage prescription, and indexing means associated with said outer cover panel related to said identification means of said second plurality and displayed simultaneously with said plurality of identification means in said closed configuration, said indexing means identifying the distinct therapeutic category of each pad of said plurality of pads and interrelating each said category with the identification means associated with the said adjacent panel member disposed outwardly of the supporting divider panel of such pad.

9. An assembly according to claim 8, wherein said line of weakness is a perforated line.

10. An assembly according to claim 8, wherein the said pluralities of identification means, open configurations and pads have the same numerical value n and said plurality of said plurality of panel members has the numerical value n+2, where n is a whole number integer greater than 1.

11. An assembly according to claim 8, wherein said distinct data includes a depiction of the pharmaceutical product.

12. A binder assembly comprising:

a binder jacket having a back panel and first and second front panels connected to opposed ends of said back panel, said front panels each having a free outer edge and extending toward each other in opposed spaced apart relationship with said back panel in a closed configuration of said jacket in which said free outer edges are adjacent, said front panels being independently foldable from said closed configuration to lie in a plane containing said rear panel, first mounting means in said back panel, said first mounting means being disposed beneath said first front panel in said closed configuration of said jacket, a pad assembly as defined in claim 8, mounted on said back panel by said first mounting means such that said outer cover panel of said pad assembly is adjacent and beneath said first front panel in said closed configuration of said jacket.

13. An assembly according to claim 12, further including second mounting means in said binder jacket, spaced from said first mounting means and a pad of prescription forms mounted in said binder jacket by said second mounting means.

14. An assembly according to claim 13, wherein said second mounting means is in said back panel disposed beneath said second front panel in said closed configuration of said jacket.

15. A binder assembly comprising:

a binder jacket, a unitary assembly as defined in claim 1, supported in said jacket, and a pad of prescription forms supported in said jacket.

16. An assembly according to claim 15, wherein said binder jacket is adjustable from a closed configuration in which said unitary assembly and said pad are substantially concealed, to an open configuration in which said unitary assembly and said pad are displayed, said unitary assembly and said pad being supported in said jacket so as to be in adjacent relationship in said open configuration.

17. A binder assembly according to claim 16 wherein said unitary assembly and said pad are in side-by-side relationship in said open configuration.

* * * * *